United States Patent [19]

Sholl

[11] Patent Number: 4,646,875

[45] Date of Patent: Mar. 3, 1987

[54] ARTICULATED BOOM STRUCTURE

[75] Inventor: Arthur F. Sholl, Omaha, Nebr.

[73] Assignee: Paxton-Mitchell Company, Omaha, Nebr.

[21] Appl. No.: 814,233

[22] Filed: Dec. 30, 1985

[51] Int. Cl.[4] ..... B66F 11/04

[52] U.S. Cl. ..... 182/2; 212/238; 212/266

[58] Field of Search ..... 182/2, 141, 148; 212/266, 267, 268, 232, 233, 238

[56] References Cited

U.S. PATENT DOCUMENTS

| | | | |
|---|---|---|---|
| 3,262,517 | 7/1966 | Malec | 182/2 |
| 3,498,474 | 3/1970 | Pierce | 182/2 |
| 4,074,790 | 2/1978 | Colbachini | 182/2 |
| 4,461,369 | 7/1984 | Amador | 182/2 |

FOREIGN PATENT DOCUMENTS

| | | | |
|---|---|---|---|
| 2058592 | 5/1972 | Fed. Rep. of Germany | 182/2 |
| 2324503 | 5/1973 | Fed. Rep. of Germany | 182/2 |

*Primary Examiner*—Reinaldo P. Machado

*Attorney, Agent, or Firm*—Henderson & Sturm

[57] ABSTRACT

This invention relates to an articulated boom structure (10) which comprises a pedestal (11) mounted for rotation on a main frame (12) mounted in turn on a vehicle (13), with a first boom (14) articulately mounted on the pedestal (11) and adapted to be raised and lowered relative to the pedestal (11), a platform (16) mounted on the outer end of the first boom (14) and adapted to be held in a horizontal plane at all times, a sweep arm (17) connected to the platform (16) above a ring gear (18) rotatably mounted on the platform (16), the sweep arm (17) movable in a horizontal plane at all times, a second boom (19) articulately connected to the outer end of the sweep arm (17) and adapted to be raised and lowered relative thereto, a third boom (21) articulately connected to the outer end of the second boom (19) and adapted to be raised and lowered relative thereto, and a personnel carrier mounted on the third boom (21), which carrier may be either a bucket (22) or a work platform (23); and with a bucket (22) movable to a vertical position relative to the third boom (21).

9 Claims, 10 Drawing Figures

ARTICULATED BOOM STRUCTURE

TECHNICAL FIELD

The structure of this invention relates generally to a vehicle mounted, self-contained hydraulic platform or basket unit for carrying personnel for inspection, maintenance or repairs of bridges, trestles, viaducts and the like. The personnel carrier is mounted in an articulated manner at the outer end of a multi-boom section movable relative to the vehicle such that the personnel carrier may be moved above, level with or below the level of the vehicle, and at arcuately moved distances therefrom for effective use. The assembly is hydraulically operated by controls on the vehicle and at the personnel carrier by conventional means.

BACKGROUND OF THE INVENTION

Articulated boom structures, with each boom having the capability of being extensible, and mounted on a prime mover such as a truck or like vehicle have been known for a number of years. The boom structures are usually mounted on a support itself mounted on the prime mover for rotation in a horizontal plane, and are either articulated by hydraulic means, such as a piston and cylinder, or by reel and cable means operated by winches. The boom structures have the primary purpose of placing the innermost end thereof at a location where either a personnel carrier, such as a bucket or work platform can be located for maintenance or construction purposes, or where a working unit, such as a cable and hook may be placed for raising or lowering equipment purposes.

The general hydraulic electric and control equipment and functions of this type of equipment are well known in the field of art. Two examples of articulated and extensible boom structures are shown in U.S. Pat. Nos. 3,262,517 and 3,498,474 issued respectively to Malec and Pierce, Jr.

DISCLOSURE OF THE INVENTION

The invention comprises a vehicle mounted, self-contained hydraulic platform or basket for personnel mounted on an articulated, extensible boom structure adapted to reach locations above, below and on either side of the vehicle, which boom structure comprises a support or base frame rotatably mounted on the vehicle for movement normally in a horizontal plane, a first boom articulately mounted on the base frame and adapted to be raised and lowered relative thereto, a sweep arm rotatably mounted on the outer end of the first boom and adapted to be horizontally moved relative to the first arm, a second boom articulately mounted to the outer end of the sweep arm and adapted to be moved vertically relative thereto, and a work unit carrying third boom articualtely mounted to the outer end of the second boom and adapted to be moved vertically and horizontally relative to the second boom.

The invention provides a boom structure which enables the personnel carrier unit to reach far more than before above and below the prime mover, regardless of the bridge or like structure thereabout.

The invention provides a boom structure which can reach around vertical girders and the like and obtain access to normally inaccessible areas for maintenance or construction, without moving the prime mover.

The invention provides further a second boom articulately connected to a sweep arm, the latter mounted for vertical movement on a horizontally movable platform affixed to the outer end of a first boom; this arrangement providing for the inner end of the second boom to be moved simultaneously in everchanging vertical and horizontal planes.

Additionally the invention provides a boom structure wherein the basket-type personnel carrier is adapted to be moved vertically relative to the outer end of the third or basket boom.

Another object of the invention is to provide a boom structure wherein the working buckets can also be raised to the vertical, for example for inspecting overhead bridge trusses.

Yet another object of this invention is to provide a boom structure capable of rotating 370° on its prime mover such that it can operate on either side of the prime mover without moving the prime mover.

BRIEF DESCRIPTION OF THE DRAWINGS

These and other attributes of the invention will become more clear upon a thorough study of the following detailed description of the best mode for carrying out the invention, particularly when reviewed in conjunction with the drawings, wherein.

BEST MODE FOR CARRYING OUT THE INVENTION

Figure 1:
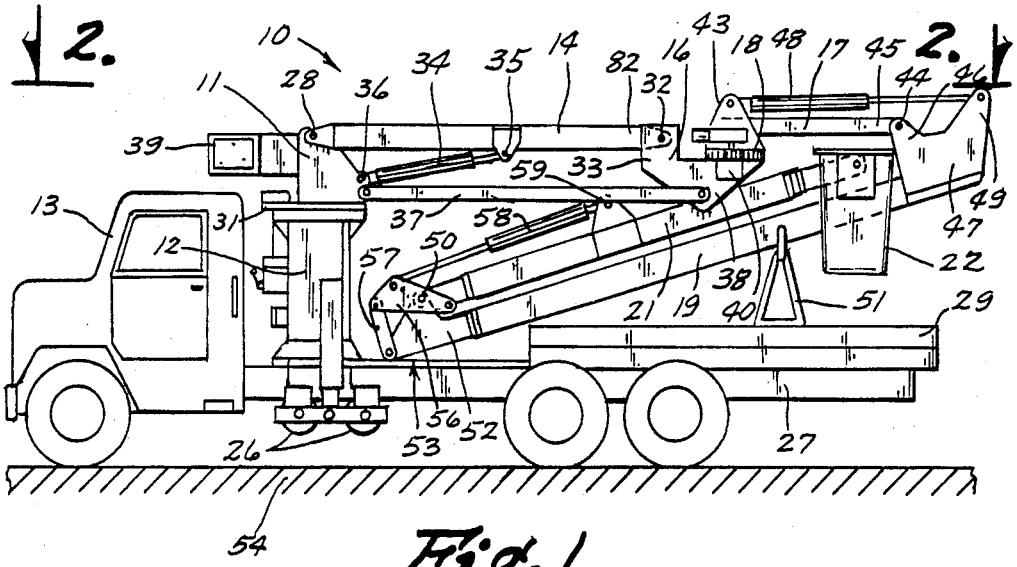
FIG. 1 is a side view of the articulated boom structure of this invention mounted on a truck.
Figure 2:
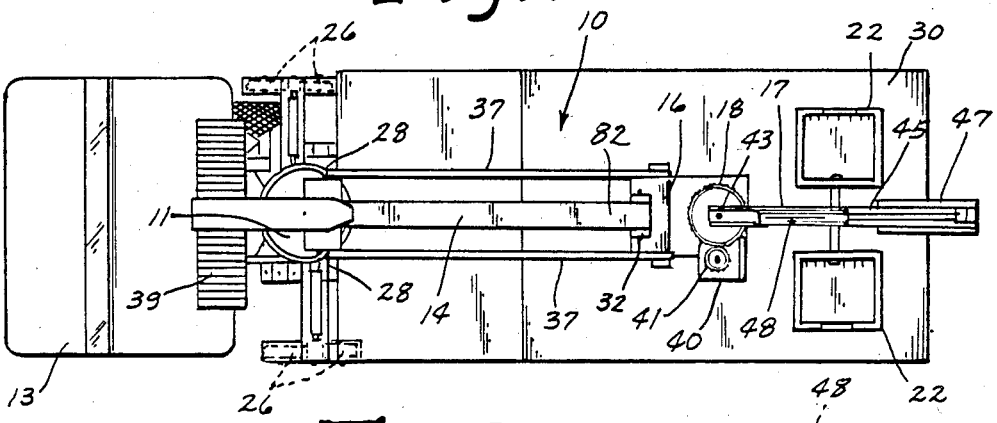
FIG. 2 is a plan view taken along the lines 2—2 in FIG. 1.
Figure 6:
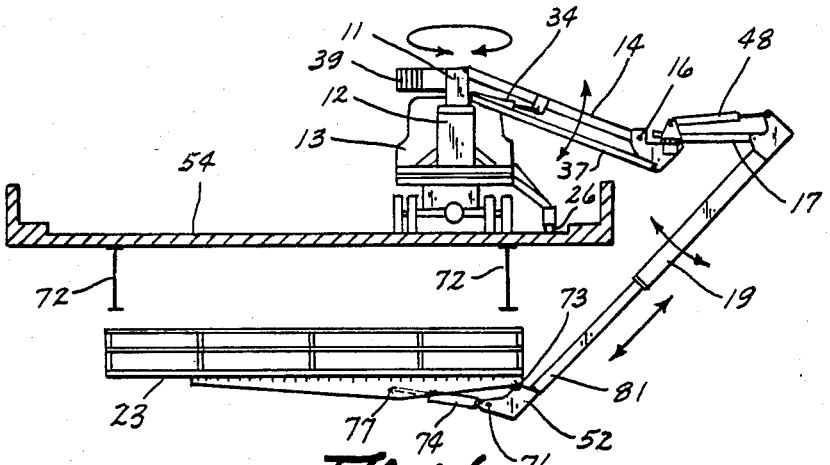
FIG. 6 is a view similar to FIG. 3, but wherein an elongated work platform is substituted for the bucket.

Referring now to the drawings, particularly FIGS. 1 and 2, the articulated boom structure of this invention is referred to generally at (10) and comprises a support or pedestal (11) mounted for rotation on the main frame (12) and about the centerline of a prime mover, a truck (13), turning 370°, with a first power boom (14) articulately mounted on the pedestal (11) and adapted to be raised and lowered relative to the pedestal (11), a platform (16) mounted on the outer end of the first boom (14) and adapted to be held in a horizontal plane at all times, a sweep arm (17) connected to the platform (16) above a ring gear (18) rotatably mounted on the platform (16), the sweep arm (17) movable in a horizontal plane at all times, a second boom (19) articulately connected to the outer end of the sweep arm (17) and adapted to be pivotally raised and lowered relative thereto, a third boom (21) articulately connected to the outer end of the second boom (19) and adapted to be raised and lowered relative thereto, and a personnel carrier mounted on the third boom (21), which carrier may be either a bucket (22) (FIG. 3) or an elongated work platform (23) (FIG. 6).

More particularly, the truck (13) is recommended to be a dual rear wheel tandem drive truck, with a transmission mounted, cab controlled power take-off (not shown), and/or a separate engine for reserve power, either source of power having sufficient power to operate the conventional, necessary hydraulic pumps (not shown) one of which is attached to the transmission by means of a power take-off and mounted under the truck frame (27) (FIG. 1). The system (not shown) for controlling the later described hydraulically operated piston and cylinder units is conventional, it being recommended that three sets of controls be provided: one of a pendant type remote from the truck (13) for operation at a side of a bridge; one set at the truck (13); and a third set at the personnel carrier (22) or (23). As the hydraulic and electric power and control systems and units are conventional and do not form a part of the invention, they will not be described in detail herein.

Figure 3:
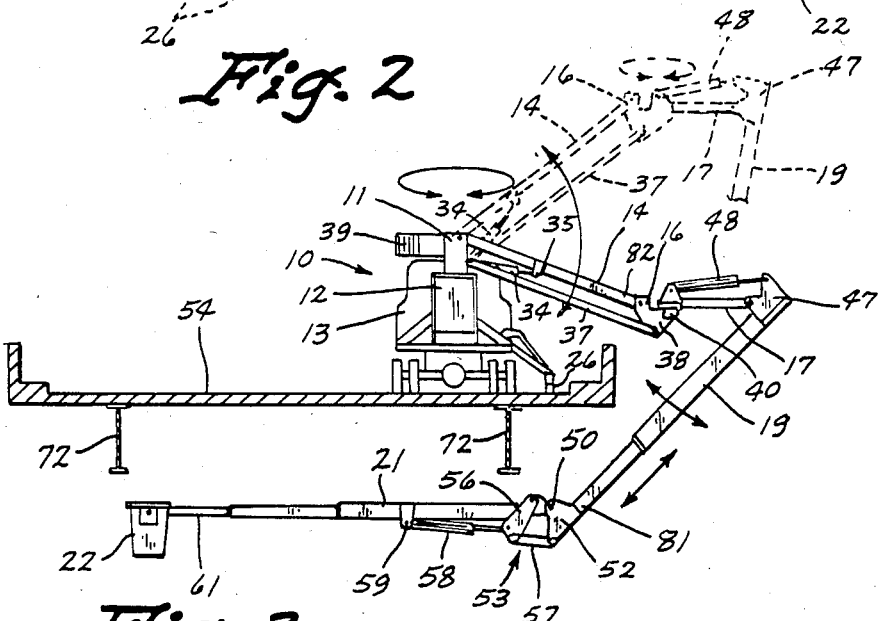
FIG. 3 is a reduced end elevational view, showing the boom structure in an unfolded condition, the second and third booms and personnel carrier disposed beneath a bridge structure, different positions indicated by dotted lines.

The power boom (14) (FIG. 1) is pivotally connected at (28) to the pedestal (11) which includes the ring gear (31) rotatably mounted for a 370° turning rotation on the main frame (12) as shown by the arrows in FIG. 3, and with the outer end of the power boom (14) pivotally mounted at (32) to the upper leg (33) of the platform (16). A hydraulically operated piston and cylinder unit (34) extends from a pivot (36) on the pedestal (11) to a connection (35) on the first boom (14) such that the articulately mounted first power boom (14) can be raised up at least to 60° above the horizontal and lowered to at least 26° below the horizontal as indicated by the arrows in FIG. 3. To maintain the platform (16) horizontally level at all times, or level with the plane of the pedestal ring gear (18) depending on the position of the vehicle (13), a pair of parallel linkage bars (37) are pivotally mounted between the pedestal (11) and the lower portion (38) of the platform (16) as best illustrated in FIGS. 1 and 2.

To counter the weight of the power boom (14) and other structure connected thereto, a counterweight unit (39) is secured to the pedestal (11). Rolling outriggers (26) are provided for supplementing the counterweight (39); however, if desirable to eliminate the outriggers (26), the counterweight (39) as depicted herein must be greatly increased as required. As shown in FIG. 6, the second boom (19) can move inwardly from a vertical position to an angle of 42° to obtain optimum reach. Although the second boom (19) is shown as being a conventional hydraulically telescoping boom, it may be non-telescoping, depending on the requirements of the area to be covered.

Figure 9:
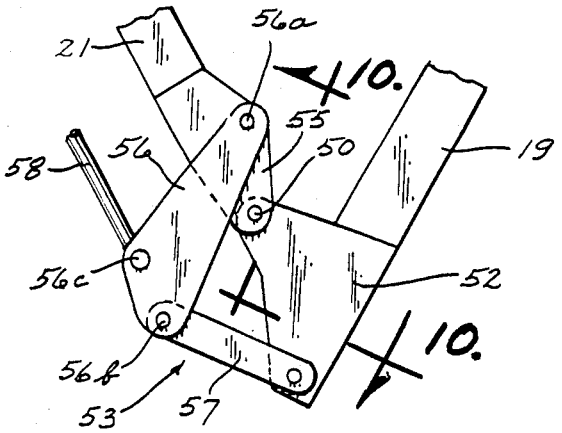
FIG. 9 is an enlarged side elevational view of the linkage between the second and third booms.
Figure 10:
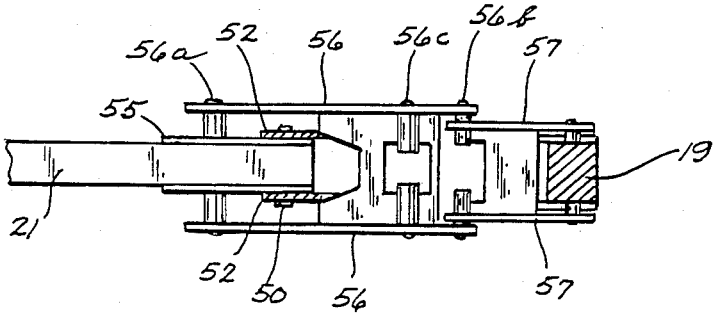
FIG. 10 is a sectional view taken on the line 10—10 of FIG. 9.

The third boom (21) is connected to the plate unit (52) second boom (19) at pivot (50) (FIGS. 1 and 9) and provided with articulated linkage indicated generally at (53) in FIGS. 3 and 5 which allows the third boom (21) to open to 160° from the second boom (19) thereby providing not only a greatly increased working depth for the third boom (21) but also providing for its attaining a substantially horizontal position below the bridge (54) or like structure (See FIG. 3). The linkage (53) includes a pair of parallel, triangular plates (56) (FIGS. 9 and 10), one corner each of which is pivotally connected at (56*a*) to a plate portion (55) of the third boom (21), another corner each being pivotally connected at (56*b*) to one end of a pair of links (57), and a third intermediate corner each being pivotally connected at (56*c*) to the inner end of a hydraulically operated piston and cylinder device (58). The other ends of the links (57) are pivotally connected to the plate unit (52) of the second boom (19). The outer end of the piston and cylinder device (58) is pivotally connected to the third boom (21) at a location (59) spaced outwardly from its connection with said plates (56). Again, although the third boom (21) is shown as being hydraulically telescoping in a conventional manner, three sections being shown, the third boom may be two sections or less, depending upon the coverage requirements.

Figure 7:
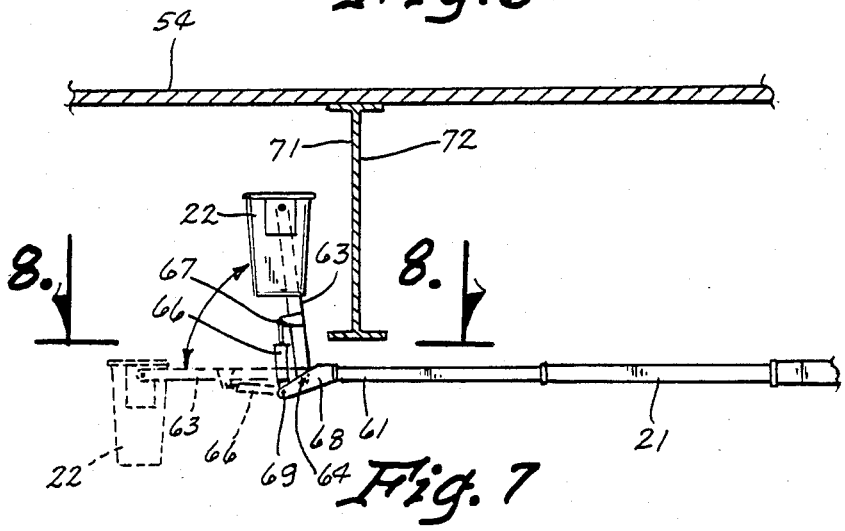
FIG. 7 is a further enlarged detail view of a personnel bucket, showing a tilt-up structure for same, which is part of the boom structure.
Figure 8:
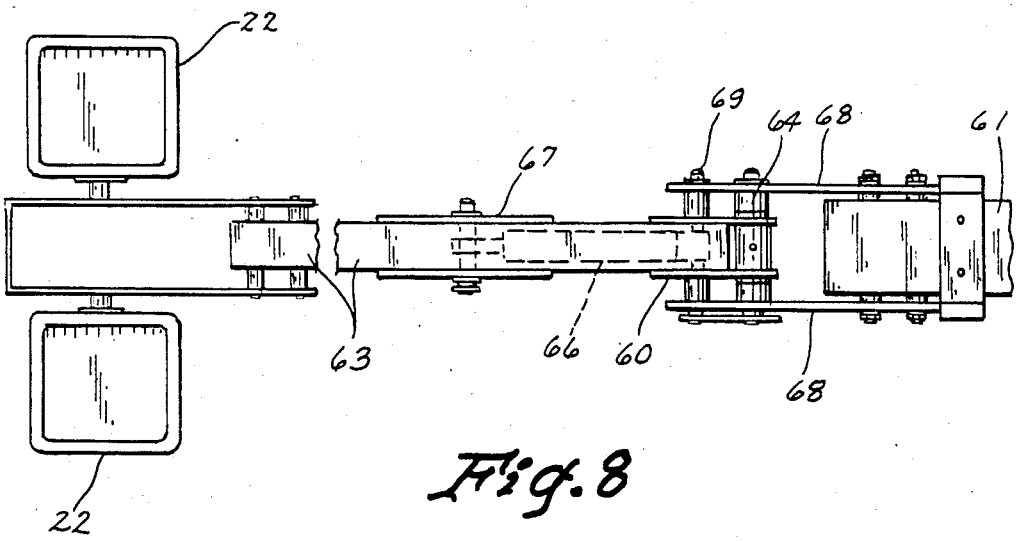
FIG. 8 is an enlarged plan view of the tilt-up structure taken along the lines 8—8 in FIG. 7.

At the outer end (61) of the third boom (21), the personnel carrier (22) (FIGS. 7 and 8) is mounted, being maintained in a level position at all times by gravity aided by a conventional hydraulically operated dampening mechanism (not shown) to eliminate undesired motion. This type of mechanism may be employed in conjunction with electrical sensors for levelling purposes. Although a two one-man bucket unit (22) is depicted, a pair of two-man buckets could also be used. To improve the reach and coverage of the bucket (22), a unique alternative arrangement is shown in FIGS. 7 and 8.

An extension boom (63), carrying the bucket (22) in a conventional levelling manner at its outer end, is pivotally connected at its inner end (60) to a pivot shaft (64), a hydraulically operated piston and cylinder device (66) has one end pivotally connected beneath the boom (63) to a strut (67) secured thereto, the other end pivotally connected at (69) to the outer end of the plate structure (68). By this arrangement, the bucket (22) is adapted to be swung upwardly to a position below the bridge (54) structure and on a side (71) of a girder (72) or like structure opposite the side of access of the remainder of the articulated boom structure (10).

Referring to FIG. 6, the conventional work platform (23) for personnel is shown pivotally mounted at (73) to a second boom plate portion (52), being articulated by a hydraulically operated piston and cylinder device (74) pivotally mounted at (76) to the plate unit (52) and at (77) to the work platform (23).

Figure 4:
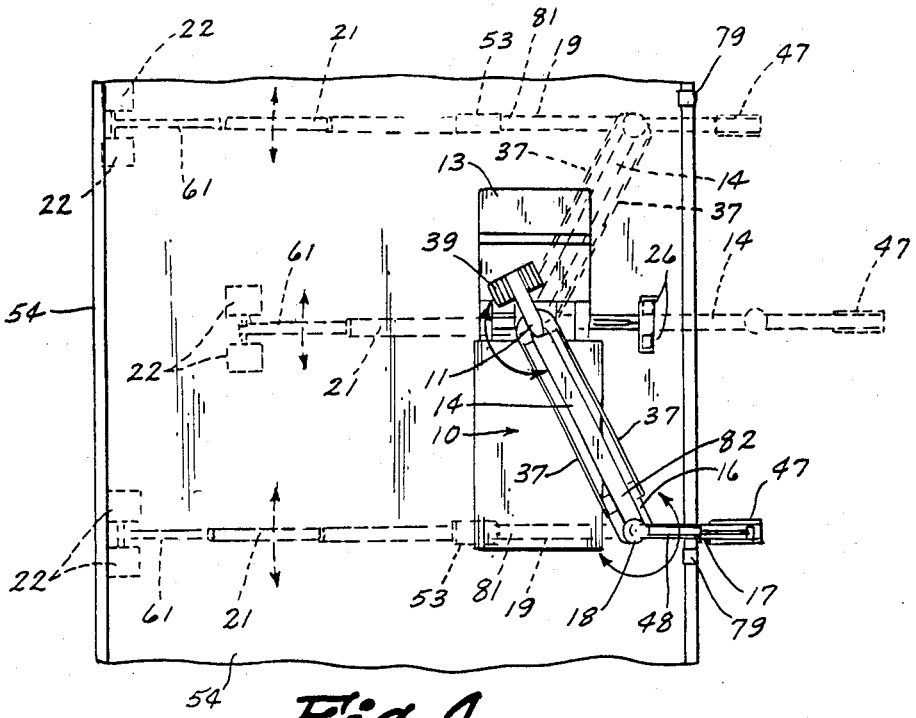
FIG. 4 is a plan view of the structure of FIG. 3, again with different positions of the booms indicated by dotted lines.

Referring to FIG. 4, it will be seen that without the provision of the sweep arm (17), should the boom structure (10) have been thrust between a pair of vertically disposed beams (78) and (79) spaced horizontally along one side of the bridge (54), for example, the area of coverage for the booms (14), (19) and (21) could be severely limited without the truck (13) moving forward or reverse to enable the boom structure to be withdrawn and reinserted; however, by the improvement of the sweep arm (17) and its capability of moving the outer end (81) of the second boom (19) at a radius equivalent the length of the sweep arm (17) from the outer end (82) of the first power boom (14), the area of coverage of the boom structure (10) at one location of the truck (13) and under the constrained condition set forth before is greatly increased.

Figure 5:
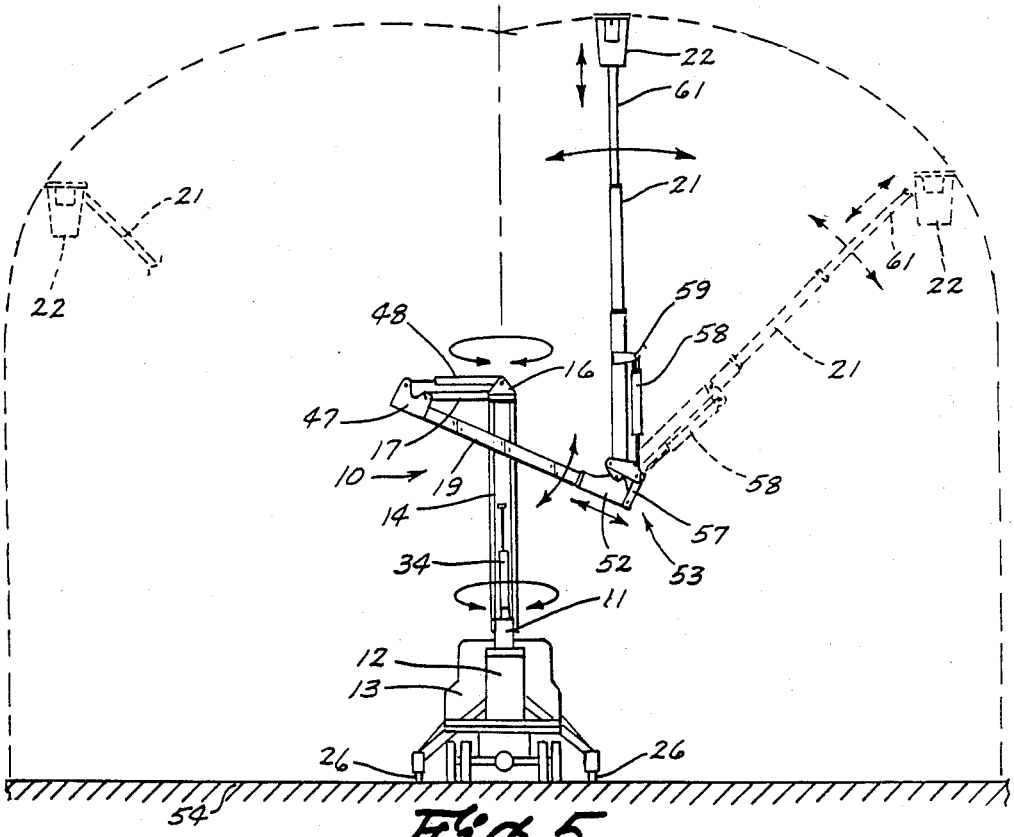
FIG. 5 is an end elevational view comparable to FIG. 3, showing alternate articulated and extended positions of the booms.

The boom structure (10) can also be used as an overhead lift for the personnel carrying basket or bucket (22) as best illustrated in FIG. 5 without detaching any of the boom sections and wherein the bucket (22) is placed vertically over the truck (13). Further, by providing the 370° rotation of the boom structure (13) on the vehicle (13), it can operate on either side of the vehicle (13), with either a proper counterweight (39) or with the rolling outrigger unit (26) on the side required. Electric controls (not shown) may be provided for ensuring that the booms will not rotate toward a vehicle side that does not have the outrigger in place. By virtue of the 370° rotation, the vehicle (13) and boom structure (10) can always face in the direction of traffic flow on both sides of a bridge, even on a one-way traffic bridge, a decided advantage over prior art boom structure arrangements capable only of working on one side of its prime mover.

I claim:

1. An extensible boom structure adapted to reach locations above and below a prime mover on which the boom structure is mounted comprising:

a support rotatably mounted on the prime mover for movement in a horizontal plane;

a first boom articulately mounted on said support and adapted to be raised and lowered relative thereto, and having a rotary unit connected to said first boom by connecting means adapted to maintain said rotary unit in a horizontal plane;

a sweep arm connected to said rotary unit and movable at all times therewith in a horizontal plane;

a second boom articulately connected to the outer end of said sweep arm and adapted to be raised and lowered relative thereto; and a third boom articulately connected to said second boom and adapted to be raised and lowered relative thereto.

2. The extensible boom structure of claim 1 wherein parallel linkage means is mounted between said support and said first boom arm unit to maintain said first boom arm unit horizontal regardless of the position of said first boom.

3. The extensible boom structure of claim 1 wherein said second boom is telescopic whereby to vary its length.

4. The extensible boom structure of claim 1 wherein said third boom is telescopic whereby to vary its length.

5. The extensible boom structure of claim 1 wherein the connection between said second and third booms comprises a plate secured to said second boom having first and second ears, one end of said third boom pivotally connected to said first ear and a link pivotally connected to said second ear; a triangular plate pivotally connected at one corner to said third boom at a location spaced outwardly from said first ear pivotal connection, and pivotally connected at a second corner to said link; and a hydraulic piston and cylinder unit pivotally connected between a third corner of said plate and a location on said third boom spaced further outwardly from said triangular plate one corner pivotal connection.

6. The extensibly boom structure of claim 1 wherein a hydraulic piston and cylinder unit is pivotally mounted at one end to said support and at the other end to said first boom for effecting movement of said first boom, and further wherein another hydraulic piston and cylinder unit is pivotally mounted at one end to said rotary unit and at the other end to said second boom at a location thereon such that the connection of said second boom with said sweep unit is inward of said connection of said second boom with said another hydraulic piston and cylinder unit.

7. The extensible boom structure of claim 6 wherein articulating means pivotally mounts a personnel carrier on an outer end of said third boom for raising and lowering said personnel carrier relative to said third boom.

8. The extensible boom structure of claim 7 wherein said support rotation places said remaining boom, boom arm and carrier structure on either side of the prime mover.

9. The extensible boom structure of claim 6 wherein said sweep arm is connected to said rotary unit adjacent to the upper side of said rotary unit, and said another piston and cylinder unit is connected to said rotary unit above said connection of said sweep arm with said rotary unit.

* * * * *